United States Patent [19]

Zimmerman et al.

[11] 4,111,013

[45] Sep. 5, 1978

[54] METHOD OF AND MACHINE FOR REMOVING OIL FROM ANIMAL HIDES

[75] Inventors: John E. Zimmerman; Richard M. Reis, Sr., both of Janesville, Wis.

[73] Assignee: Northern Conveyor & Manufacturing Corp., Janesville, Wis.

[21] Appl. No.: 812,521

[22] Filed: Jul. 5, 1977

[51] Int. Cl.[2] ..... C14B 1/08

[52] U.S. Cl. ..... 69/21; 69/41

[58] Field of Search ..... 69/21, 48, 43, 41, 33; 100/221, 160, 176, 121, 37

[56] References Cited

U.S. PATENT DOCUMENTS

| | | | |
|---|---|---|---|
| 3,236,074 | 2/1966 | Cleaves | 69/21 |
| 3,654,781 | 4/1972 | Plechac | 69/41 |

FOREIGN PATENT DOCUMENTS

| | | | |
|---|---|---|---|
| 1,441,113 | 6/1976 | United Kingdom | 69/43 |

*Primary Examiner*—Patrick D. Lawson

*Attorney, Agent, or Firm*—Ira Milton Jones & Associates

[57] ABSTRACT

A method and machine for removing naturally occurring oil from animal hides, especially pig skins, which comprises passing the hides in the condition they are in at the conclusion of the conventional curing operation, with the hair side facing downward, between a small diameter solid-surfaced roll and a much larger diameter power-driven cylinder having a resiliently yieldable surface, the cylinder being above the roll so that the hair side of the hides is in contact with the roll, and the cylinder being forced down onto the roll with sufficient pressure to cause the surface of the cylinder to conform to the curvature of the roll as it and a hide move across the roll to thereby progressively subject narrow band-like zones of the hair side of the hide alternately to compression and tension forces transversely of said zones, and before the internal structure of that portion of the hide can recover from the alternate collapse and expansion of its pores that results from the compression and stretching of its hair side, repeating the action by passing the hide between a second solid-surfaced roll and the cylinder.

11 Claims, 7 Drawing Figures

28
26
24
25
26
29
32
11
7
18
19
17
12
21
20
16
14
15
32
6
13
5
29
10
26
27
25
31
23
26
28

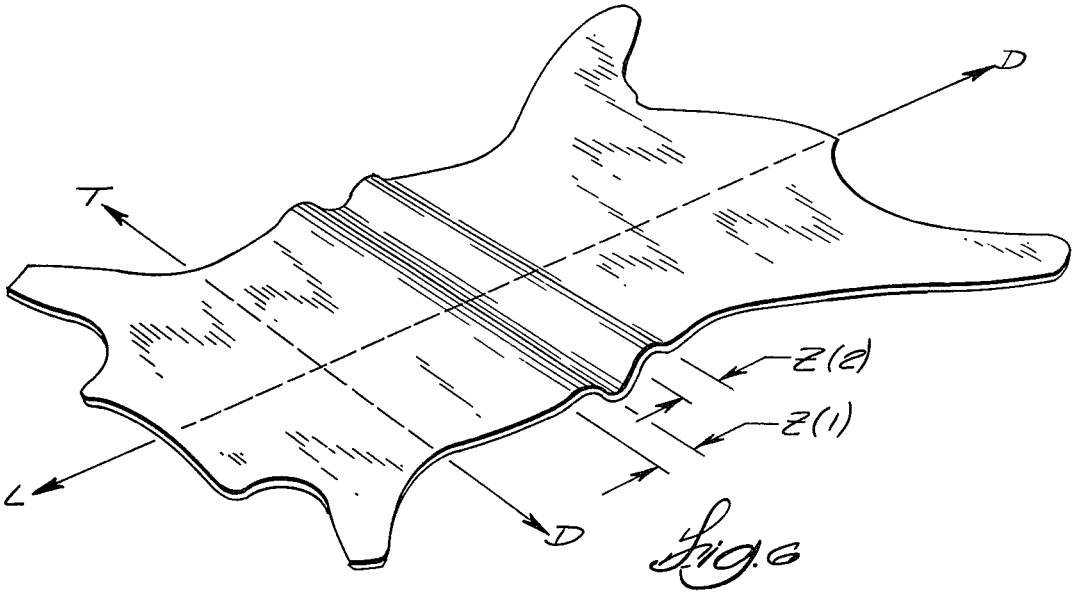
Fig. 6
Fig. 7
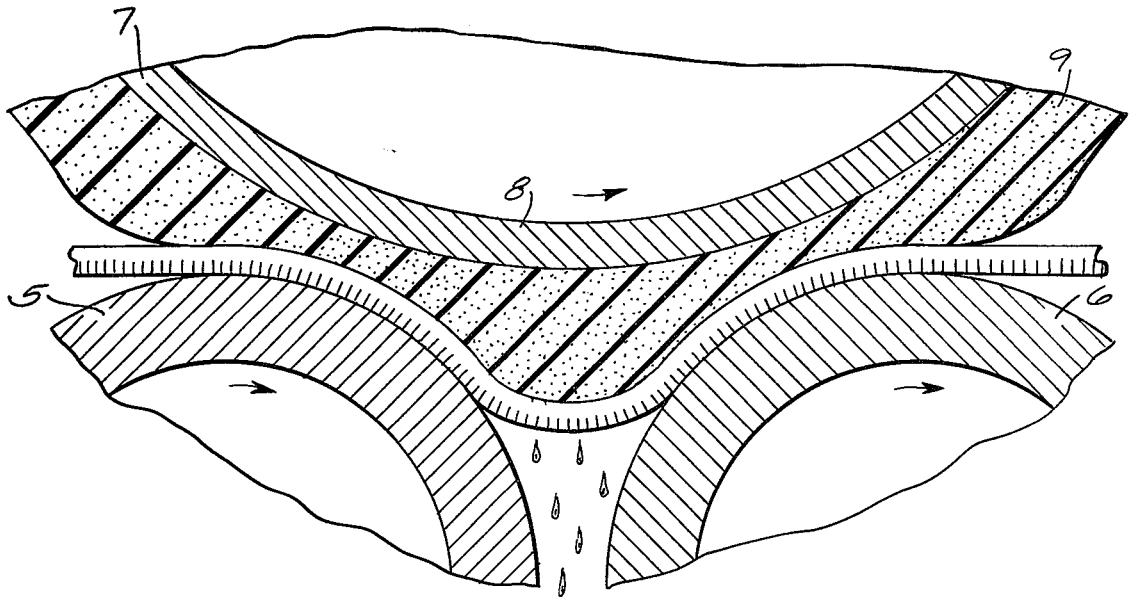

METHOD OF AND MACHINE FOR REMOVING OIL FROM ANIMAL HIDES

This invention relates to the treatment of animal hides and, more especially, pig skins, preparatory to tanning and/or other subsequent processing.

While all animal hides that have been cured in the conventional manner—which usually involves tumbling them for several hours in a salt-brine solution—contain oil, pig skins are exceptionally oily. In fact, the oil content of pig skins is so great that it is impossible to stack or pile them on pallets. Even a relatively few skins laid on the floor, one on top of the other, will slither off each other. This extreme slipperyness makes it difficult to handle cured pig skins.

It has long been recognized that a practical way of removing the oil from pig skins would be a boon to the hide and leather-working industry, especially since oil extracted from pig skins has significant economic value. But, until the present invention, there has been no way of economically removing oil from animal hides, and especially from pig skins.

Needless to say, it is therefore the purpose and object of this invention to provide an economically feasible method and a machine with which to practice the method, of removing naturally occurring oil from animal hides and especially from pig skins.

With these observations and objectives in mind, the manner in which the invention achieves its purpose will be appreciated from the following description and the accompanying drawings, which exemplify the invention, it being understood that changes may be made in the precise method of practicing the invention and in the specific apparatus disclosed herein without departing from the essentials of the invention set forth in the appended claims.

The accompanying drawings illustrate one complete example of the method of practicing the invention according to the best mode so far devised for the practical application of the principles thereof, and in which.

Figure 1:
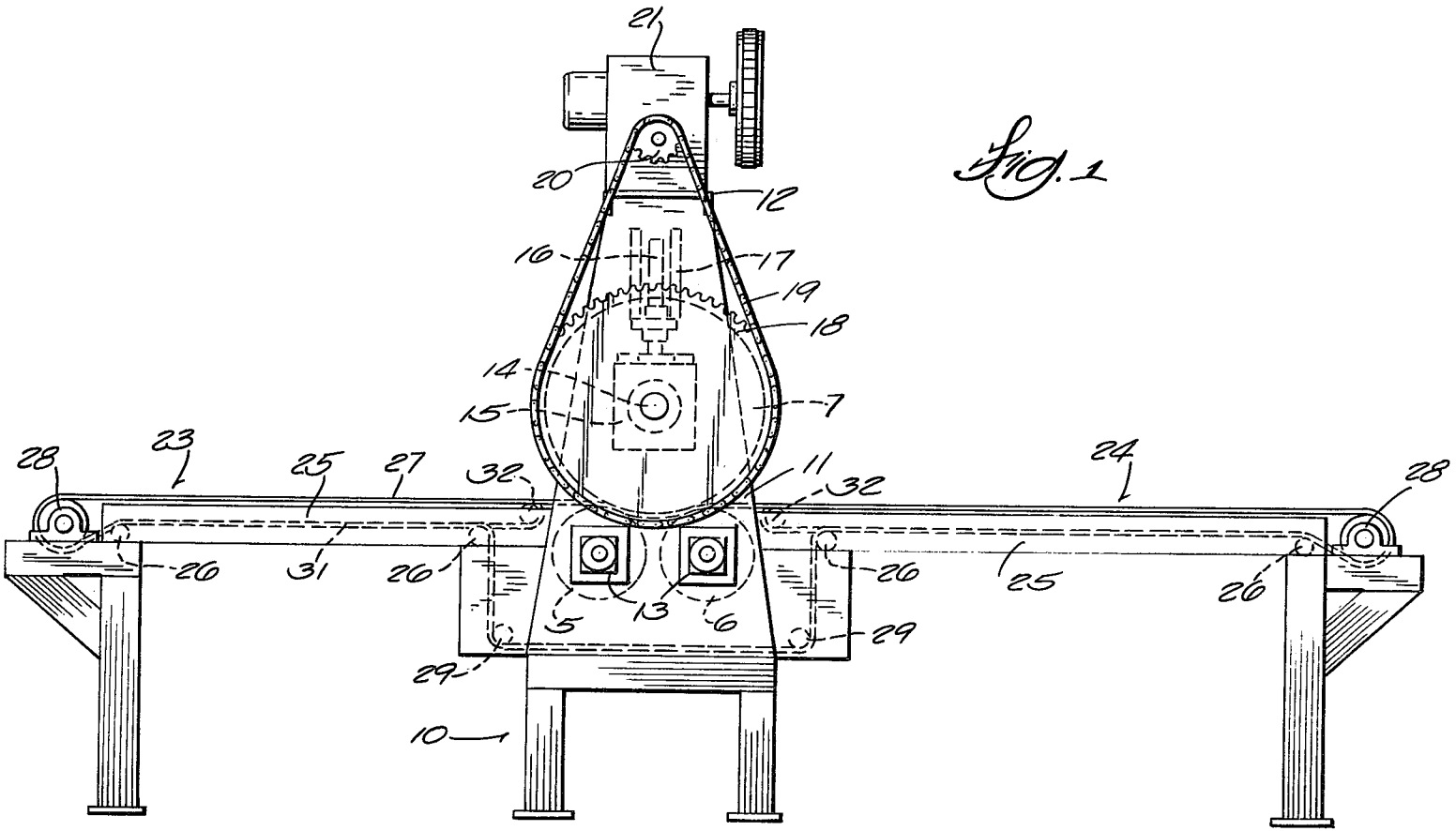
FIG. 1 is a side view of the machine with which the method of this invention is performed.
Figure 2:
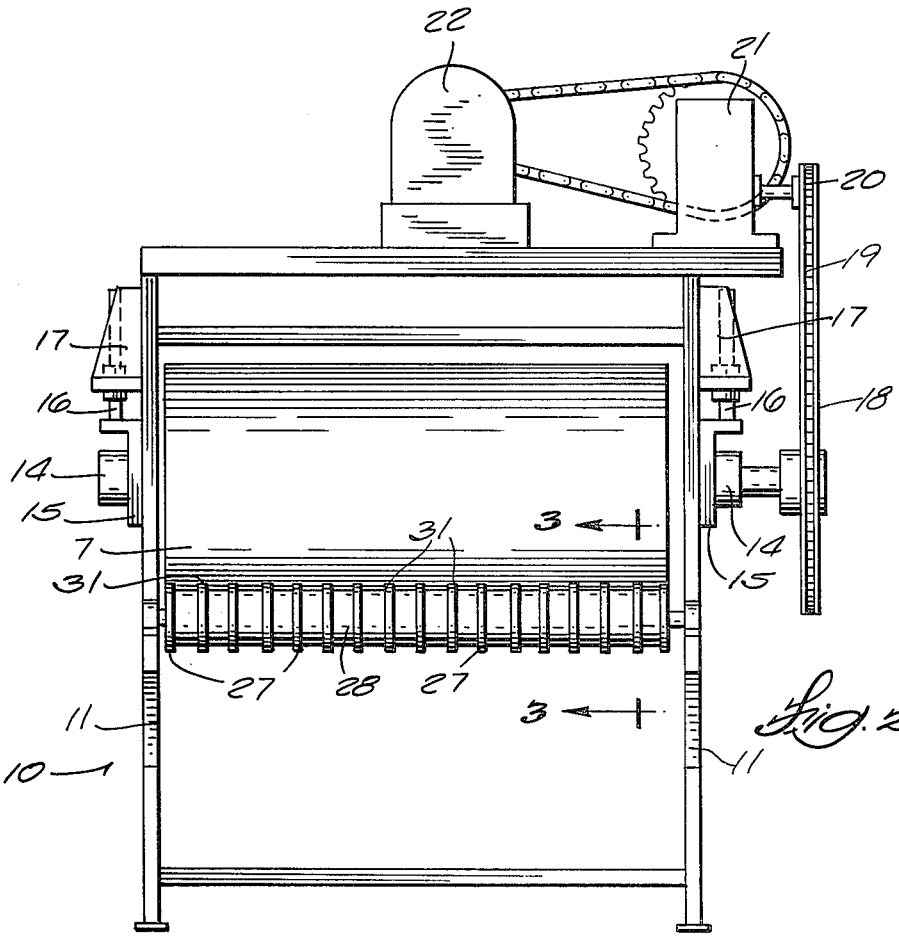
FIG. 2 is a front end view of the machine.

FIG. 6 diagrammatically illustrates a pig skin being subjected to the oil extracting process of this invention; and FIG. 7 in greatly exaggerated form illustrates how, by the practice of this invention, the hide is subjected to a progression of undulations as it passes through the machine and, by that action, has its hair side successively crowded or compressed and stretched in the direction the hide moves through the machine.

Before describing the machine illustrated in FIGS. 1-5, by which the method of the invention is practiced, it should be noted that essentially the invention consists in a method of removing oil naturally present to a large degree in pig skins, which method comprises taking the pig skins, in the condition they are at the conclusion of the conventional curing operation, and—with the hair side down—subjecting narrow band-like zones thereof that extend across the width of the hide, to a progression of alternately upward and downward flexures as the hides move through a machine especially designed to impart such undulations. FIG. 6 diagrammatically depicts a pig skin in the process of having two narrow band-like zones Z(1) and Z(2) transversely subjected to these alternately upward and downward flexures.

A pig skin, of course, has a lengthwise dimension LD and a transverse dimension TD, and the narrow band-like zones of action extend transversely all the way across the hide, and progress—wave-fashion—along the lengthwise dimension of the hide as the hide moves through the machine employed to practice the invention.

As will be more fully explained hereinafter, the part of the machine that acts on the hide consists of a pair of horizontally oriented relatively small diameter solid-surfaced freely rotatable rolls 5 and 6 and a much larger diameter cylinder 7 located above and pressed down onto the rolls. The cylinder is power driven and coacts with both rolls to grip and squeeze the hide in a manner that alternately imparts upward and downward flexure to the narrow band-like zones Z(1) and Z(2). To achieve that result, the surface portion of the cylinder is resiliently yieldable or deformable so that—as shown in FIG. 7—the portions of the cylinder pressed against the rolls are deformed into conformance with the curvature of the rolls. By that deformation of the cylinder surface and its restoration to its cylindrical shape, the hair side of the narrow transversely extending portions of the hide being squeezed between the cylinder and the rolls are successively subjected to compression and tension forces acting transversely of the narrow bands, and—since this occurs at the underside of the cylinder and the hair side of the hide faces downward—the resulting successive collapse and expansion of the pores of the hide expresses oil from the hide. It is significantly important that in addition to being resiliently yieldable or deformable, the material of which the surface of the cylinder is formed be non-absorbent and definitely not bibulous.

By having the rolls 5 and 6 closely adjacent to one another, the second narrow band-like zone Z(2) is subjected to the pore-collapsing and expanding action before the internal structure of the hide can restore itself from the effects of the action in the first narrow zone Z(1).

In actual practice of the invention, as much as 1 to 1½ pounds of oil is recovered from a single pig skin. Apart from the obvious economic advantage that results from this very useful oil recovery (it is an excellent lubricant for high speed automobile engines) the removal of the oil, along with water still present from the curing operation, effects at least a 10 percent reduction in shipping weight, so that the cost of getting the hides to tanneries is significantly lowered. And, of course, by virtue of the oil having been removed, the pig skins are far more easily handled—no longer do they slither off each other when piled onto a pallet.

As originally designed, the cylinder 7 consisted of a plurality of side-by-side automobile tires held tightly together on a drive shaft. The tread of the tires was modified to present substantially a continuous cylindrical surface, and the tires were inflated to twenty pounds of pressure.

In an improvement over that original design, the cylinder consists of a metal drum 8 with a rubber shell 9 vulcanized to it. This shell is at least three-quarters of an inch thick and has a hardness (yieldability) measurement of 50–70 Shore durometer. Rubber, of course, is not bibulous.

Figure 5:
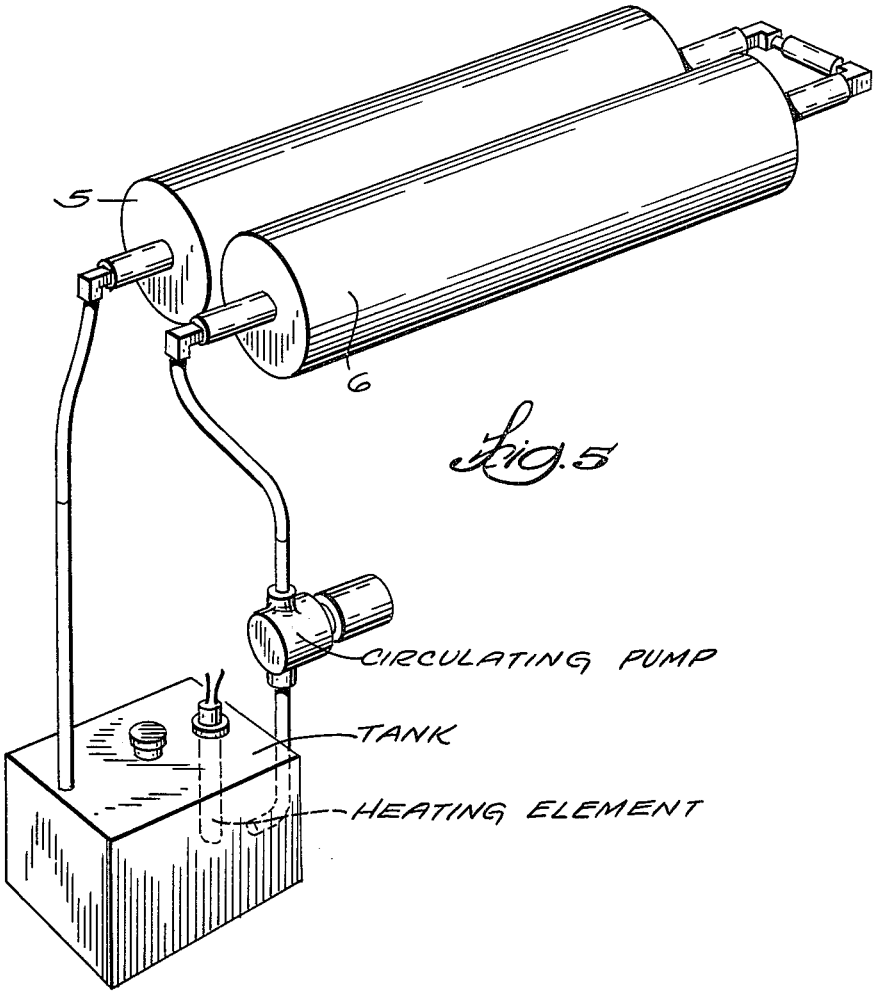
FIG. 5 is a perspective view diagrammatically illustrating an optional feature of the machine.

The rolls 5 and 6 are preferably steel and are hollow to enable circulation through them of a heating medium, conventionally hot water—as illustrated in FIG. 5, to facilitate the oil removal operation when ambient temperature drops. If its use is indicated, the heating medium should enter the rolls at a temperature of 85°–90° Farenheit.

Continuing with a more detailed description of the machine, it has a main frame 10 with upright side members 11 connected by a plurality of cross members including a top rail 12. The rolls 5 and 6 and the cylinder 7 span the distance between the upright side members and are supported thereby for rotation on parallel horizontal axes. For this purpose, the shafts that project coaxially from the ends of the rolls and the cylinder are respectively journalled in bearings 13 and 14. The bearings 13 are fixed to the side members of the frame, and the bearings 14 are fixed to slides 15 that are vertically adjustably mounted on the side members of the frame. Pressure applying screws 16 react between the slides 15 and brackets 17 fixed to the frame side members to force the cylinder down onto the rolls 5 and 6 with sufficient force to deform the resiliently yieldable surface shell of the cylinder into conformity with the cylindrical contour of the rolls.

Attention is directed to the fact that the axis of the cylinder lies on a vertical plane that is equispaced from the axes of the rolls, and since the rolls are of the same diameter, a symmetrical relationship exists between the cylinder and the rolls and the pressure with which the cylinder coacts with both rolls is identical.

The rolls 5 and 6 are not driven, but the cylinder is. For that purpose a sprocket 18 fixed with respect to the cylinder is drivingly connected by means of a roller chain 19 with the output sprocket 20 of a reduction gear assembly 21 mounted on the top rail 12 and driven by an electric motor 22, also mounted on the top rail.

Figure 3:
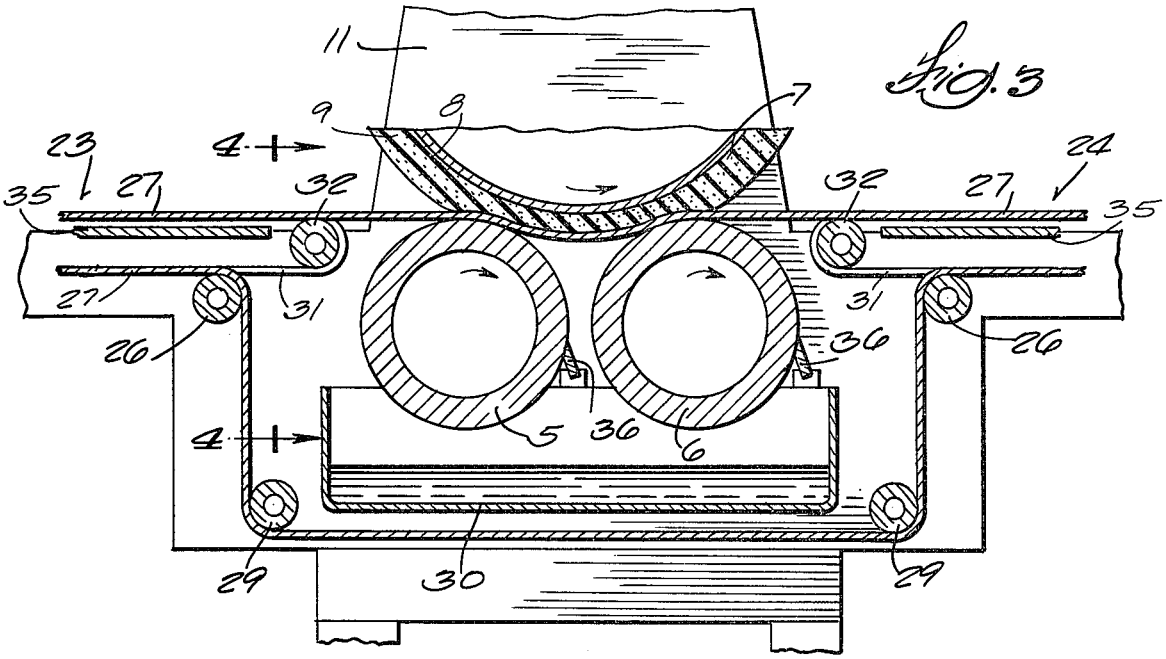
FIG. 3 is a vertical sectional view through the machine taken substantially on the plane of the line 3—3 in FIG. 2.

The direction in which the cylinder is driven advances its periphery successively across the rolls 5 and 6 to thereby cause hides fed to the machine to move from left to right, as viewed in FIGS. 1 and 3. Accordingly, the roll 5 should be considered the front roll and the roll 6 the back roll.

Hides are fed to the machine by an infeed conveyor 23 and carried from the machine by an outfeed conveyor 24. Each of these conveyors consists of a horizontally oriented frame having side rails 25 connected at their inboard ends to the side frame members 11 and, at their outboard ends, by suitable cross members.

Extending across the space between the side rails of each conveyor, there are transversely extending spaced apart freely rotatable rolls 26—one near the machine frame and the other remote therefrom. These rolls support the bottom stretches of a plurality of spaced parallel endless Nylon belts 27 that are trained over adjustable belt tensioning rolls 28 at the outer ends of the conveyor frames. The top stretch of the endless belts of the infeed conveyor 23 carries hides placed thereon into the bite between the cylinder 7 and the front roll 5 and hence this stretch of the belts is tangent to the roll 5.

Not only is the top stretch of the conveyor belts tangent to the front roll 5, but it continues around the underside of the cylinder and across the top of the back roll 6 to the belt tensioning roll 28 of the outfeed conveyor 24. Accordingly, the top stretch of the conveyor belts is gripped between the cylinder and the rolls 5 and 6 and advanced thereby. This obviates the need for an independent drive for the conveyor belts.

The returning bottom stretch of the conveyor belts travels over the freely rotatable rolls 26 of the outfeed conveyor, then downwardly to and under a pair of guide rolls 29 that are freely rotatably mounted in the machine frame at an elevation low enough to accommodate an oil collecting pan 30 that is suitably mounted in the machine frame beneath the rolls 5 and 6 to collect the oil removed from the hides. After passing under and around the guide roll 29 at the front of the machine, the bottom stretch of the conveyor belts travels upwardly to and around the inboard one of the rolls 26 of the infeed conveyor.

Although the Nylon conveyor belts could be spaced closely enough to obviate intermediate support for the hides being carried thereby, it has been found desirable to provide each conveyor with a second group of endless Nylon conveyor belts 31 that are located between the belts 27 with their top stretches coplanar with those of the belts 27. The belts 31, however, are confined to their respective conveyors so as not to interfere with the flow of oil from the hides into the collecting pan 30; and hence are trained over rolls 32 adjacent to the front and rear rolls 5 and 6 as well as the belt tensioning rolls 28. By virtue of their engagement with the rolls 28, the belts 31 are driven at the same speed as the belts 27.

Figure 4:
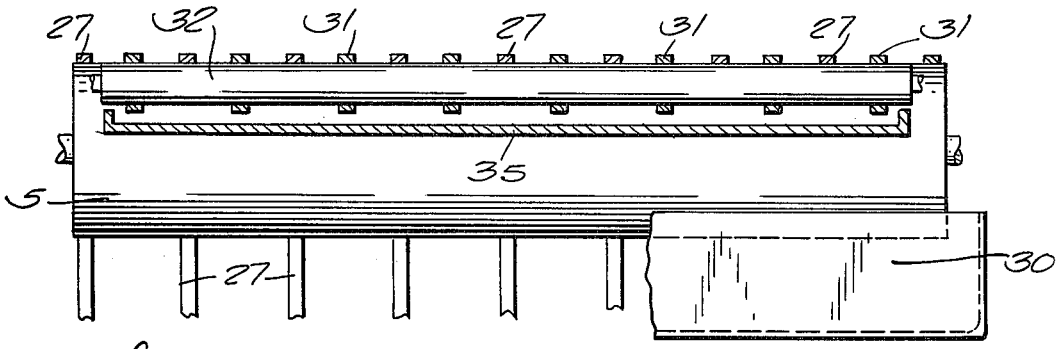
FIG. 4 is a fragmentary sectional view through FIG. 3 on the plane of the line 4—4.

If desired, the conveyors 23 and 24 may be equipped with trays located below the top stretches of the belts 27 and 31, as indicated at 35 in FIGS. 3 and 4. If they are used, these trays should be formed of material that can withstand the corrosive effect of the conditions to which hide treating and working equipment is subjected.

With the machine in operation, an operator places the hides—in the condition they are at the conclusion of the conventional salt brine curing operation—on the infeed conveyor 23, with its hair side down, and makes sure that the hide is straightened out before it enters the machine. As the hide is then gripped between the cylinder 7 and the front roll 5, narrow band-like zones thereof that extend across the width of the hide are successively squeezed between the resiliently yieldable non-absorbent and definitely not bibulous surface of the cylinder and the non-yielding solid surface of the roll 5. As these zones pass between the cylinder and the roll 5, they are subjected to the described flexure by which the hair side thereof is transversely compressed and stretched. Before the internal structure of the just "worked" narrow band-like zones can recover from the pore collapsing and expanding forces that were imparted to it, they are squeezed between the cylinder and the back roll 6 and thus again subjected to the same forces. The oil expressed from the hides by these successive actions is stripped from the rolls 5 and 6 by doctor blades 36 and flows down into the pan 30 from which it can be removed in any suitable way.

Those skilled in the art will appreciate that the invention can be embodied in forms other than as herein disclosed for purposes of illustration.

The invention is defined by the following claims:

We claim:

1. A method of removing naturally present oil from an animal hide, which method comprises:

with the hide in the condition it is at the conclusion of the curing operation to which hides are conventionally subjected preparatory to further treatment, passing the hide with its hair side down successively between the underside of a large diameter power driven horizontally oriented cylinder having a resiliently deformable but non-absorbent, definitely not bibulous surface, and two small diameter solid surfaced rolls that are parallel to one another and to the cylinder and are located at the underside of the cylinder; and maintaining sufficient pressure between the cylinder and the rolls to cause said resiliently deformable but non-absorbent, definitely not bibulous surface of the cylinder to progressively conform to the curvature of the solid surfaced rolls as said surface comes into pressure-exerting coaction with the rolls, to thereby flex narrow band-like zones of the hide alternately upward and downward and, by such flexure, subject the hair side of the said band-like zones of the hide alternately to compression and tension forces that successively collapse and expand the pores of the hide and thereby express oil that collects in the pores.

2. The method of claim 1, further characterized by:

so positioning the two small diameter solid surfaced rolls with respect to one another that said flexure of narrow band-like zones of the hide is repeated before the internal structure of the hide has time to recover from the stresses resulting from the first flexure.

3. The method of claim 1, further characterized by:

placing a pan under the two small diameter solid-surfaced rolls to collect the oil that is expressed from the hide; and, by doctor blades bearing against the surface of said rolls, directing the expressed oil into the pan.

4. The method of claim 1, further characterized by:

heating and maintaining the small diameter solid-surfaced rolls at a temperature of 85° to 90° Farenheit.

5. A machine of the character described comprising the combination of:

A. a frame having upstanding side members;

B. a pair of solid-surfaced parallel closely spaced rolls extending horizontally between said side members of the frame and freely rotatably supported thereby;

C. a cylinder that is considerably larger in diameter than said rolls extending between said side members of the frame above the rolls and freely rotatably supported by said side members for rotation about an axis that is parallel to the axes of the rolls and lies in a vertical plane between the rolls, the cylinder having a surface layer that is resiliently deformable, non-absorbent and definitely not bibulous;

D. pressure means maintaining the cylinder and rolls engaged with sufficient force to deform the engaged portions of the resiliently deformable surface layer of the cylinder and conform the surface thereof to the curvature of the rolls; and E. means operable to receive and feed sheet material through the machine with said material moving successively between the rolls and the cylinder.

6. The machine of claim 5 further characterized by:

means to support sheet material being fed through the machine as it passes across the space between said rolls.

7. The machine of claim 5, wherein the axes of said rolls are fixed with respect to the frame, wherein the cylinder has shaft portions at its ends journaled in bearings vertically adjustably mounted on the side members of the frame, and wherein said pressure means reacts between the frame and said bearings.

8. The machine of claim 5, wherein said rolls have the same diameter and are equispaced from said vertical plane.

9. A machine for removing naturally present oil from animal skins that have been subjected to a conventional curing operation, comprising the combination of:

A. a frame having upright side members;

B. front and back solid-surfaced rolls journalled in bearings fixed to the frame side members, with their axes horizontal and parallel;

C. a cylinder considerably larger in diameter than the rolls, said cylinder having a surface layer that is resiliently deformable, non-absorbent and definitely not bibulous;

D. a pair of bearings in which shaft portions at the ends of the cylinder are journalled;

E. means mounting said bearings on the side members of the frame for vertical adjustment with the axis of the cylinder lying in a plane that is equispaced from the axes of the rolls and above the rolls;

F. pressure exerting means reacting between the side frame members and said bearings, pressing the cylinder down onto the rolls with sufficient force to deform the engaged portions of the resiliently deformable surface layer of the cylinder and conform the surface thereof to the curvature of the rolls;

G. power means drivingly connected with the cylinder to impart rotation thereto in the direction in which its underside moves successively across the front and back rolls; and H. means to receive and feed hides through the machine with the hides passing successively between the front roll and the cylinder and then between the back roll and the cylinder, so that as the hides pass through the machine relatively closely spaced narrow band-like areas thereof that extend across the width of the hides are transversely alternately flexed upwardly and downwardly by the coaction of the rolls with the resiliently deformable surface layer of the cylinder.

10. The machine of claim 9, wherein said means to receive and feed hides through the machine comprises:

a plurality of spaced apart side-by-side endless conveyor belts with upper and lower stretches, the former being tangent to the solid-surfaced front and back rolls and extending across the underside of the cylinder so that said endless belts are driven by the cylinder.

11. The machine of claim 9, wherein said solid-surfaced rolls are hollow, and further characterized by:

means for circulating a heating fluid at a temperature less than 90° F. through the hollow solid-surfaced rolls.

* * * * *